US007950851B2

(12) United States Patent
Taheri

(10) Patent No.: US 7,950,851 B2
(45) Date of Patent: May 31, 2011

(54) PLASTIC BAG WITH IMPERFORATED TEAR AREA

(75) Inventor: Nossi Taheri, Atlanta, GA (US)

(73) Assignee: Thunderbird Global Enterprises, LLC, Atlanta, GA (US)

( * ) Notice: Subject to any disclaimer, the term of this patent is extended or adjusted under 35 U.S.C. 154(b) by 993 days.

(21) Appl. No.: 11/775,752

(22) Filed: Jul. 10, 2007

(65) Prior Publication Data

US 2008/0285896 A1 Nov. 20, 2008

Related U.S. Application Data

(60) Provisional application No. 60/938,009, filed on May 15, 2007.

(51) Int. Cl.
*B65D 33/00* (2006.01)
*B65D 33/16* (2006.01)

(52) U.S. Cl. ..... 383/63

(58) Field of Classification Search ..... 383/5, 61.2, 383/63, 66, 200, 201, 84
See application file for complete search history.

(56) References Cited

U.S. PATENT DOCUMENTS

| | | | | | |
|---|---|---|---|---|---|
| 3,323,707 | A * | 6/1967 | King | 383/200 |
| 3,780,781 | A * | 12/1973 | Uramoto | 383/204 |
| 4,744,674 | A * | 5/1988 | Nocek | 383/63 |
| 5,102,234 | A * | 4/1992 | Levy | 383/38 |
| 5,372,428 | A * | 12/1994 | Bruno et al. | 383/5 |
| 6,004,032 | A * | 12/1999 | Kapperman et al. | 383/5 |
| 6,149,302 | A * | 11/2000 | Taheri | 383/5 |
| 7,090,397 | B2 * | 8/2006 | Stolmeier | 383/64 |
| 2005/0025392 | A1 * | 2/2005 | Stolmeier | 383/5 |
| 2006/0204147 | A1 * | 9/2006 | Stolmeier | 383/5 |
| 2007/0206888 | A1 * | 9/2007 | Chang | 383/200 |

* cited by examiner

*Primary Examiner* — Jes F Pascua
(74) *Attorney, Agent, or Firm* — Parks IP Law LLC; Cynthia Parks, Esq.

(57) ABSTRACT

A plastic specimen bag (10) includes a front wall (20) and a rear wall (22) that are joined together to define a containment portion (32) having a bottom (24), side edges (26, 28), and a top opening (30). The plastic specimen bag (10) further includes a first closure (C1) located between the bottom (24) and the top opening (30) for selectively closing the containment portion (32). To facilitate opening the specimen bag (10), the specimen bag (10) includes a first grip enhancing profile (50) and a second grip enhancing profile (52) that are formed in the front wall (20) and spaced apart from one another to define a tear area (54) therebetween. The tear area (54) is located between the closure (C1) and the bottom (24).

18 Claims, 6 Drawing Sheets

PLASTIC BAG WITH IMPERFORATED TEAR AREA

RELATED APPLICATIONS

This application claims priority to U.S. Provisional Application No. 60/938,009, filed May 15, 2007, the entirety of which is herein incorporated by reference.

TECHNICAL FIELD

This invention relates generally to containers and, more specifically, to sealable or reclosable plastic bags.

BACKGROUND

Specimen bags are useful in various clinical settings, such as clinical laboratories, pathology labs, and doctors' offices, for secondary containment and transport of biohazard material, such as blood, urine, or tissue that is first disposed in a primary container, such as a tube or vial. The specimen bag is to lock and seal the specimen in the bag to prevent tampering or spilling until the specimen is to be removed from the bag.

Due to the hazardous nature of such specimens, various international institutions, such as the International Air Transportation Association (IATA) and the World Health Organization (WHO), have created basic standards for the specimen bags. For example, certain standards require the specimen bag to include imperforated walls that are at least three mils (three thousandths of an inch) thick, leak proof seals and closures, and the ability to handle an internal air pressure of ninety-five kilopascals.

Specimen bags are typically opened by technicians in high volume facilities that analyze the contents. Technicians are typically required to wear protective gloves when opening the specimen bags, which compromises manual dexterity. Thus, it is difficult and time consuming for the technician to open the specimen bag and the method of opening the bag can easily result in loss of the specimen as the bag may tear open suddenly or in an uncontrolled manner.

To facilitate rapid removal of a specimen from a specimen bag, several approaches have been developed. Because perforating the bag walls is not permissible, the simplest approach involves cutting an opening in the bag using a tool such as a utility blade, scissors or a specially designed bag cutter. The approach leaves the technician vulnerable, however, in view of the inherent danger associated with handling a sharp implement, particularly while handling biohazardous materials.

Therefore, a heretofore unaddressed need exists in the industry for a sealable specimen bag with an improved opening feature that can be easily and quickly operated particularly under conditions that limit the dexterity of the user.

SUMMARY

The various embodiments of the present invention overcome the shortcomings of the prior art by providing a plastic specimen bag that includes grip enhancing profiles to allow a user to easily open the sealed specimen bag. Specifically, the grip enhancing profiles aid a user that has limited dexterity, such as a user wearing plastic gloves, to open the specimen bag.

According to a first embodiment, a plastic specimen bag includes a front wall and a rear wall that are joined together to define a containment portion which has a bottom, side edges, and a top opening. A first closure is located between the bottom and the top opening for selectively closing the containment portion. In general, the closure extends between the side edges. First and a second grip enhancing profiles are formed in the front wall and are spaced apart from one another to define a tear area therebetween. The tear area is located between the closure and the bottom and a tear is propagated through the tear area to open the plastic bag once it is sealed. The tear area has a thickness that is not substantially less than the thickness of the remainder of the front wall.

Each of the first and second grip enhancing profiles comprises a series of raised ribs. In certain embodiments, the raised ribs in each series of raised ribs are increasingly spaced apart as each series approaches the tear area. Further, in certain embodiments the raised ribs in each series of raised ribs are decreasingly raised and/or decrease in width as each series approaches said tear area.

In certain embodiments, the specimen bag further includes third and fourth grip enhancing profiles that are formed in the rear wall and that are spaced apart from one another to define a tear area therebetween. The tear area in the rear wall is substantially aligned with the tear area in the front wall. Further, the third grip enhancing profile is substantially aligned with the first grip enhancing profile and the fourth grip enhancing profile is substantially aligned with the second grip enhancing profile. Providing grip enhancing profiles in both the front wall and the rear wall further improves a user's grip on the specimen bag when opening the specimen bag.

In alternative embodiments, the specimen bag includes a flap that is joined to the rear wall to form a pouch. In certain of these embodiments, the flap includes a severance line that is aligned with the front wall tear area such that the pouch does not inhibit the method of opening the specimen bag. In other of these embodiments, the specimen bag includes third and fourth grip enhancing profiles that are formed in the flap and spaced apart from one another to define a tear area therebetween. The flap tear area is substantially aligned with the front wall tear area to facilitate opening both the containment portion and the pouch.

In certain embodiments, the first closure includes a male profile on one of the front rear walls and a female profile on the other of the front and rear walls. The male profile and the female profile can engage one another to seal or close the containment portion. In certain embodiments, the specimen bag also includes a second closure that is located between the first closure and the top opening, which also includes a male profile and a female profile. The first and second closures can be either releasable or non-releasable. For example, the first closure can be a releasable closure and the second closure can be a non-releasable closure. Alternatively, the first closure can be a non-releasable closure and the second closure can be a releasable closure.

The specimen bag can include means for initiating a tear in the tear zone. For example, the tear initiation means can include a notch that formed in at least one of the side edges and in the tear area.

The grip enhancing profiles can extend across the front wall in different directions. For example, the first grip enhancing profile and the second grip enhancing profile can extend substantially perpendicular to the side edges. In addition, the first grip enhancing profile and said second grip enhancing profile extend between said side edges. Alternatively, the first grip enhancing profile and the second grip enhancing profile can extend at an angle with respect to or parallel to the side edges.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE OF THE DRAWINGS

DETAILED DESCRIPTION OF THE INVENTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Figure 1:
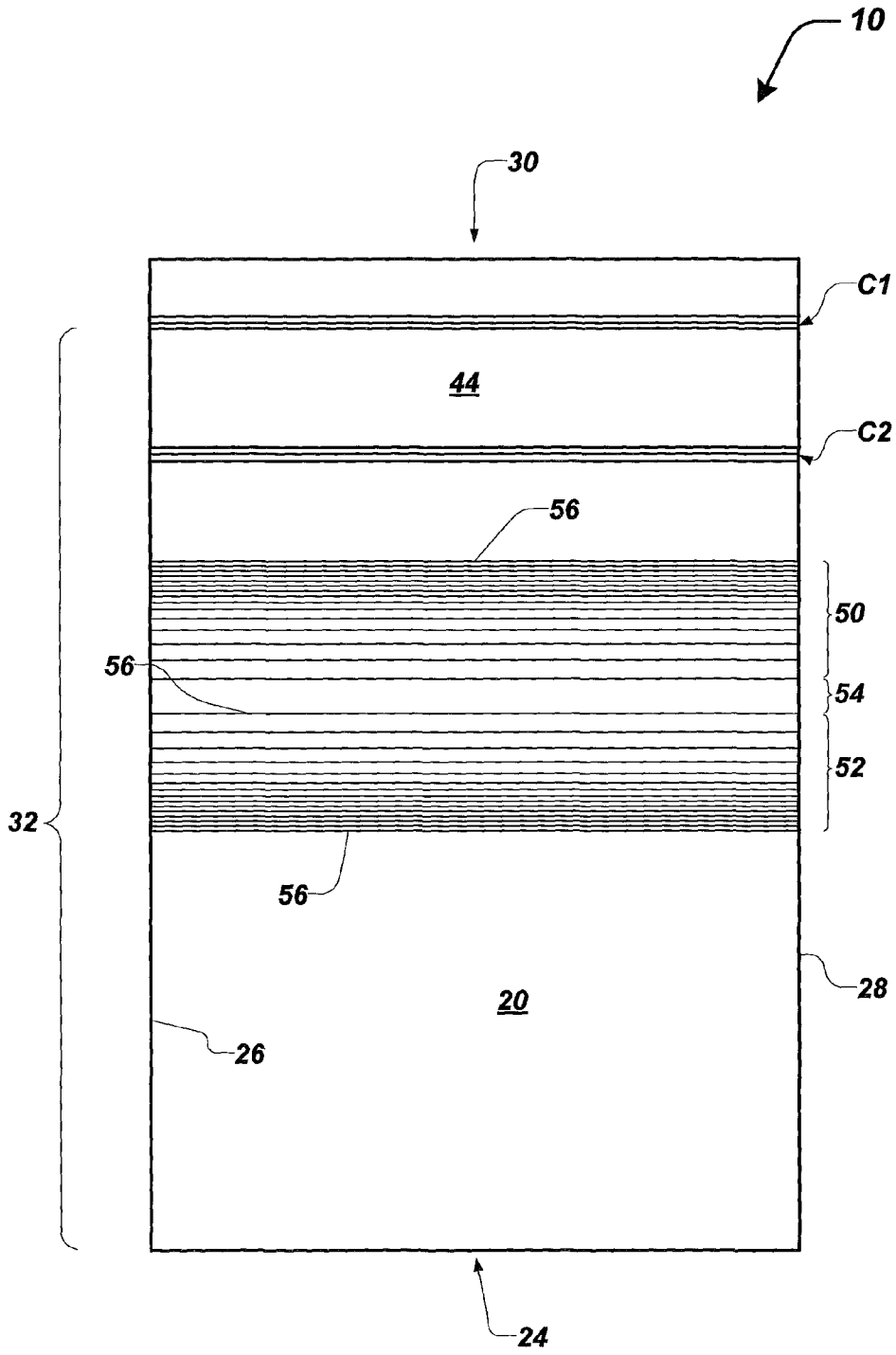
FIG. 1 is a front elevation view of a plastic bag according to a first embodiment of the present invention.
Figure 2:
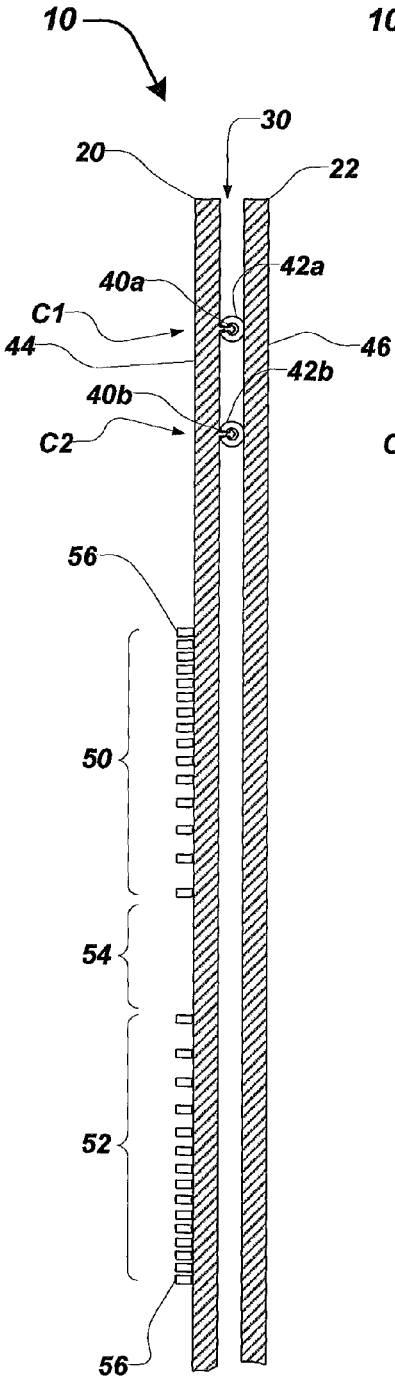
FIG. 2 is an enlarged fragmentary cross-sectional view of the plastic bag of FIG. 1 showing grip enhancing profiles that include a series of ribs with gradually varying spacing therebetween.

Referring to FIGS. 1 and 2, a plastic bag 10 is illustrated according to an exemplary embodiment of the present invention. For purposes of teaching and not of limitation, the exemplary embodiments of the invention will be described in the context of a plastic bag for securely packaging and transporting potentially hazardous laboratory specimens. However, the plastic bag 10 would be useful in any number of applications, for example, as a secure receptacle for preserving the chain of custody of physical evidence collected at a crime scene.

Use of the term "plastic bag" does not evidence an intent to limit the bag to being made of plastic material. Rather, it is contemplated that other materials that are not categorized as plastics but have similar characteristics can be used to produce bags so as to provide substantially the same advantages as plastic materials.

The bag 10 can be produced from materials including, but not limited to, polyethylene (PE), low density polyethylene (LDPE), linear low density polyethylene (LLDPE), polypropylene (PP), ethyl vinyl acetate (EVA), polymers, copolymers, block-copolymers, the like, and blends thereof. As an example, a blend of approximately 10% EVA, approximately 30% LLDPE, and approximately 60% LDPE can be utilized to produce a bag having desirable degrees of pliability, clarity, brittleness, and the like. As an alternative example, a blend of LDPE and LLDPE can likewise be used.

Continuing with FIGS. 1 and 2, generally described, the bag 10 includes a front wall 20 and a rear wall 22 that are connected to one another along a bottom 24 and side edges 26, 28 of the bag 10. The top edges of the front wall 20 and the rear wall 22 (FIG. 2) are separable from one another to provide a top opening 30 that provides access into the interior of the bag 10. The bag 10 has a substantially consistent wall thickness.

The bag 10 includes upper and lower zipper-like closures C1, C2 that are positioned between the bottom 24 and the top opening 30 and that extend transversely, that is, between the side edges 26, 28. Referring to FIG. 1, as used herein, the term transverse is defined as extending generally along the width of the bag 10, which is measured between the side edges 26, 28. The area of the bag 10 that is between the upper zipper-like closure C1 and the bottom 24 of the bag 10 is referred to as the containment portion 32. When either or both closures C1, C2 is closed, the containment portion 32 is hermetically sealed to prevent entry of contaminants into the containment portion 32 and/or to preventing leaking from the containment portion 32.

The closures C1, C2 are arranged so as to be substantially parallel to one another. Using a pair of closures offers several advantages, including redundancy, and the ability to choose between a permanent or a temporary seal. It should be understood that, in the various potential embodiments of the invention, the bag can include one closure or more than two closures.

Referring particularly to FIG. 2, elements of each of the zipper-like closures C1, C2 are integral to the walls 20, 22 of the plastic bag 10. Each zipper-like closure C1, C2 includes a male profile 40*a*, 40*b* that is integral to the front wall 20 and a female profile 42*a*, 42*b* that is integral to the rear wall 22. The male profiles 40*a*, 40*b* and the corresponding female profiles 42*a*, 42*b* are capable of engaging one another to close the top opening 30 of the bag 10 so as to seal the containment portion 32.

In the exemplary embodiments, the lower closure C2 is a non-releasable closure and the upper closure C1 is a releasable closure, although any combination of any suitable types of releasable and non-releasable closures can be used. A non-releasable closure is one that is substantially permanently closed once the elements thereof are engaged whereas a releasable closure can be repeatedly closed and opened. The upper and lower closures C1, C2 are spaced apart in part to prevent the non-releasable lower closure C2 from being inadvertently closed as the upper closure C1 is closed. However, it should be understood that, in alternative embodiments, either or both the upper and lower closures C1, C2 can be either releasable or non-releasable. Colors or other indicia may alert the user of the nature of a closure to avoid inadvertent use of a non-releasable closure before a permanent seal is desired. For example, the lower closure C2 can be colored red to indicate that the closure is a permanent closure.

The male profile 40*a* of the upper closure C1 includes a barbed rib that is dimensioned to be received in the female profile 42*a*, which includes a pair of hook-shaped ribs that define a groove. The hook-shaped ribs engage the barbed rib to releasably interlock the male and female profiles 40*a*, 42*a*. The interlocking engagement is designed to resist inadvertent separation of the male and female profiles 40*a*, 42*a*, for example, due the pressures created by the contents of the bag 10. However, the strength of the interlocking engagement is designed such that the male and female profiles 40*a*, 42*a* can be intentionally separated from one another, as described in further detail below.

The male profile 40*b* of the lower closure C2 includes a barbed rib that is dimensioned to be received in the female profile 42*b*, which is a pair of hook-shaped ribs that define a groove. It should be understood the shapes of the profiles 40*b*, 42*b* are modified from those of the profiles 40*a*, 42*a* such that the interlocking engagement between the profiles 40*b*, 42*b* provides a permanent connection. One or both of the male elements 40*a*, 40*b* alternatively can be attached to the rear wall 22 and one or both of the female elements 42*a*, 42*b* can be attached to the front wall 20.

The bag 10 includes lips 44, 46 that are generally defined between the lower closure C2 and the top opening 30. As described in further detail below, the lips 44, 46 are portions of the bag 10 that facilitate opening the upper and lower closures C1, C2.

According to the first embodiment illustrated in FIGS. 1 and 2, the front wall 20 includes first and second grip enhancing profiles 50, 52 that define an opening feature of the bag 10. The grip enhancing profiles 50, 52 enable a user to pull the bag apart without the need for weakening any portion of the bag 10. The grip enhancing profiles 50, 52 extend transversely across the front wall 20 between the side edges 26, 28, and are spaced apart from one another to define a tear area 54 therebetween. It should be noted that in the embodiments shown in the figures, the thickness of the film in the tear area 54 is substantially the same as the thickness of the front and rear walls 20, 22. Alternatively, the grip enhancing profiles of the various embodiments can be implemented along with a relatively thinner tear area (not shown), such as by providing a score line (not shown) to thin the tear area somewhat.

Figure 3:
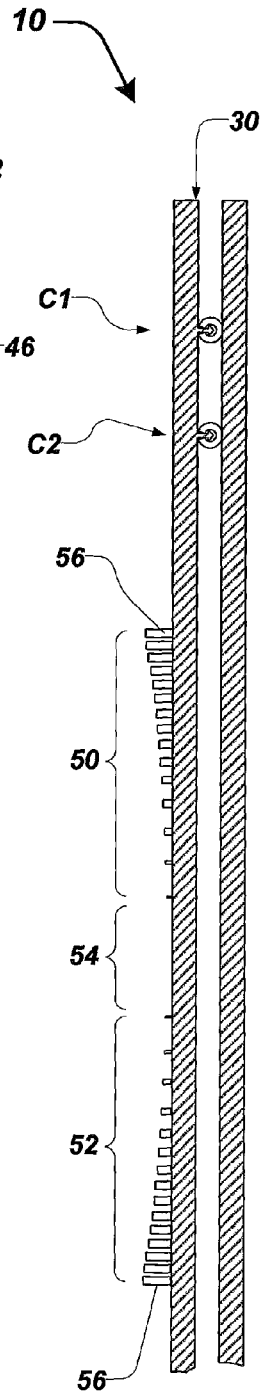
FIG. 3 is an enlarged fragmentary cross-sectional view of a plastic bag according to a second embodiment of the present invention showing alternative grip enhancing profiles having a series of ribs that gradually vary in spacing, height, and width.
Figure 4:
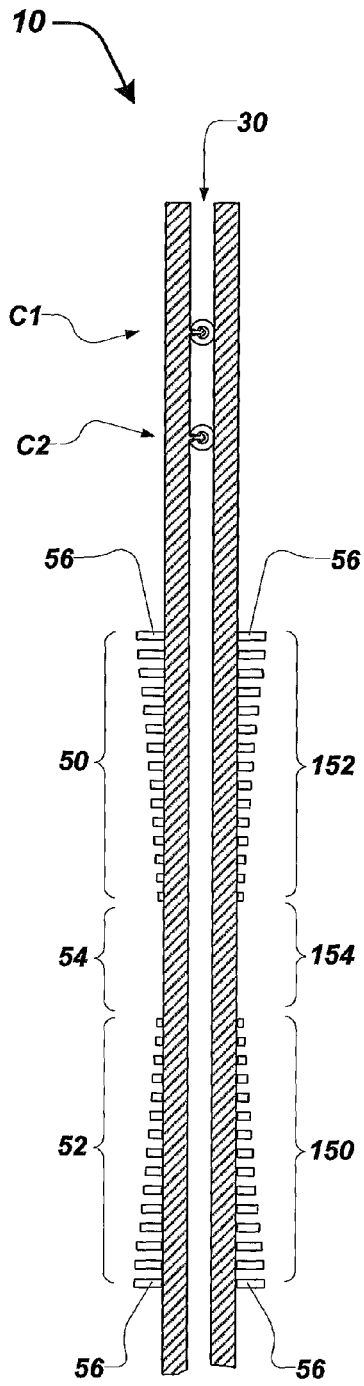
FIG. 4 is an enlarged fragmentary cross-sectional view of a plastic bag according to a third embodiment of the present invention showing alternative grip enhancing profiles on the front and rear walls, each having a series of equally spaced ribs that gradually vary in height.

Referring to the embodiments illustrated in FIGS. 2, 3 and 4, generally described, each of the grip enhancing profiles 50, 52 includes a series of raised ribs 56 that are dimensioned and arranged to provide traction so as to facilitate or optimize a user's grip on the bag 10. Thus, as a user grasps the bag 10 at the grip enhancing profiles 50, 52 and pulls in opposite directions, the bag 10 is easily separated at the tear area 54.

The ribs 56 are sculpted, arranged, and spaced apart from one another at selected distances to maximize the effect of the grip enhancing profiles 50, 52. As shown in the first embodiment of FIG. 2, each grip enhancing profile 50, 52 includes a series of ribs 56 that are increasingly spaced apart as the series of ribs 56 approaches the tear area 54. In other words, the density of ribs 56 in each grip enhancing profile 50, 52 is greater in the regions of the grip enhancing profiles 50, 52 that are further from the tear area 54 and is less in the regions of the grip enhancing profiles 50, 52 that are nearer to the tear area 54. With this arrangement, a path of least resistance for a transverse tear is defined through the relatively weaker and less rigid tear area 54 and as the grip enhancing profiles 50, 52 prevent a longitudinal tear therethrough.

The ribs 56 can be sculpted and their dimensions determined according to the characteristics of the particular application to optimize the grip enhancing profiles 50, 52. Referring to a second embodiment illustrated in FIG. 3, the height and width of the ribs 56 in each series of ribs 56 gradually decrease as each series of ribs 56 approaches the tear area 54. This arrangement provides additional traction and support, for example, as a tear is propagated by pulling the grip enhancing profiles 50, 52 in opposite longitudinal directions. A third embodiment illustrated in FIG. 4 demonstrates that the ribs 56 in each of the grip enhancing profiles 50, 52 can be substantially evenly spaced apart, have substantially the same width, and vary in height.

An exemplary method of opening the bag 10 is now described. With momentary reference again to FIGS. 1 and 2, the closures C1, C2 are pre-opened and a specimen (not shown) can be inserted into the containment portion of the bag 10. Thereafter, the upper closure C1 is closed to at least temporarily seal the specimen in the bag 10. When permanent closure is desired, the lower closure C2 can be closed to prevent additional handling or tampering prior to the specimen reaching its destination, where will be used, tested, or analyzed.

Figure 5:
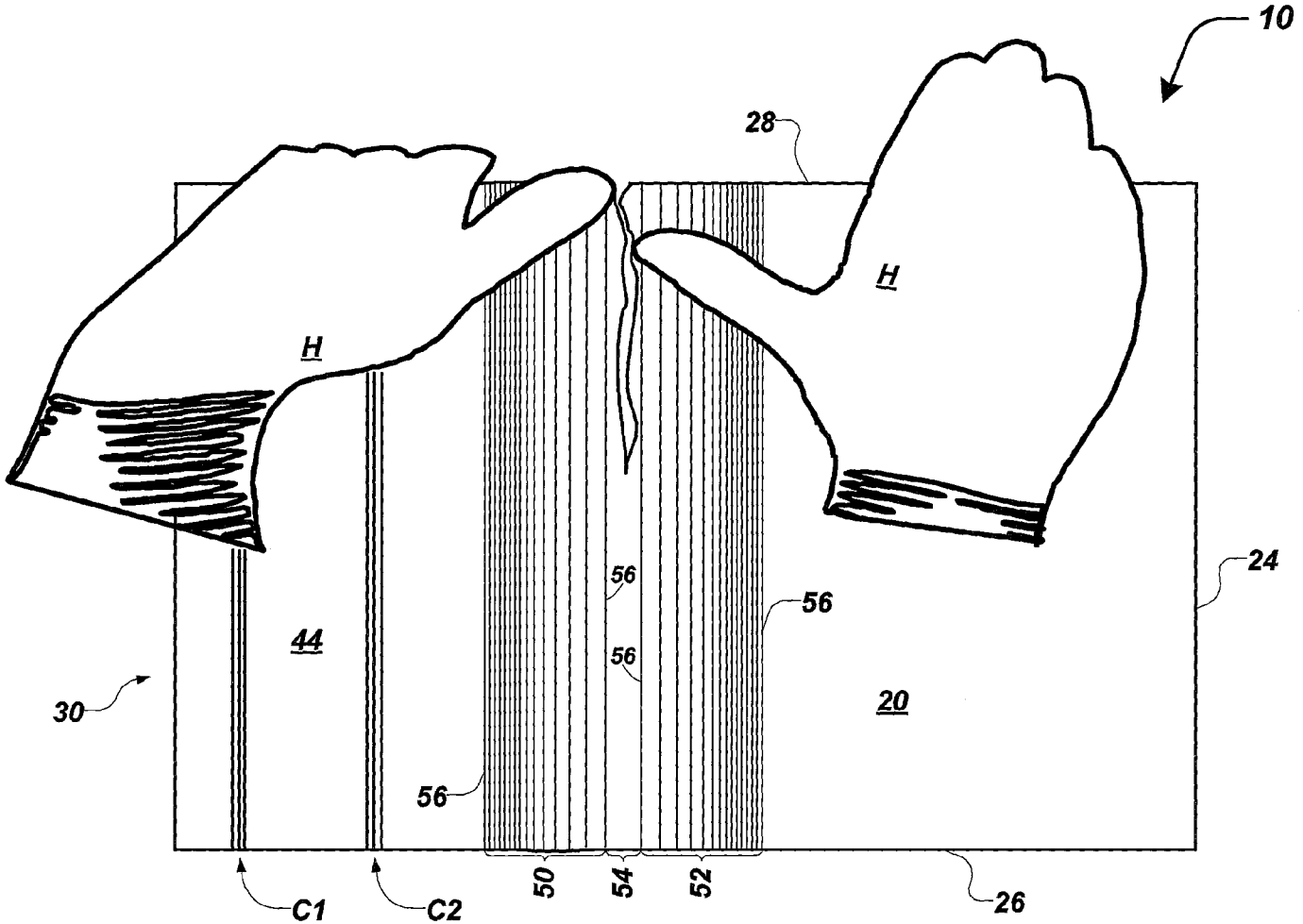
FIG. 5 illustrates a step according to an exemplary method of opening the plastic bag of FIG. 1.

Once the lower closure C2 is closed, the bag 10 is most easily opened by operating the tear feature. Referring now to FIG. 5, the user grips the bag 10 with the thumb of one hand H engaging the grip enhancing profile 50 and the thumb of the other hand H engaging the grip enhancing profile 52 and pulls or twists in substantially opposite directions to initiate and propagate a tear along the tear area 54. It should be understood that the grip enhancing profiles 50, 52 provide a user with a better grip of the bag 10, which makes tearing the bag 10 easier. This is especially important when the user is wearing gloves that lessen the dexterity of the user.

In certain embodiments, such as the third embodiment illustrated in FIG. 4, the rear wall 22 of the bag 10 can include third and fourth grip enhancing profiles 150, 152, which define a complementary tear area 154 therebetween. In such embodiments, the tear area 54 in the front wall 20 is substantially aligned with the tear area 154 in the rear wall 22. Likewise, the grip enhancing profiles 150, 152, of the front wall 20 can be aligned with the grip enhancing profiles of the rear wall 22. Those skilled in the art will readily appreciate that it is not necessary in most instances to provide grip enhancing profiles in both the front and rear walls 20, 22, because the traction provided by just one set can facilitate sufficient shearing force to tear both walls 20, 22 at once. In any event, the dual wall arrangement of FIG. 4 is useful, for example, for thicker materials or for users with weaker hands.

Figure 6:
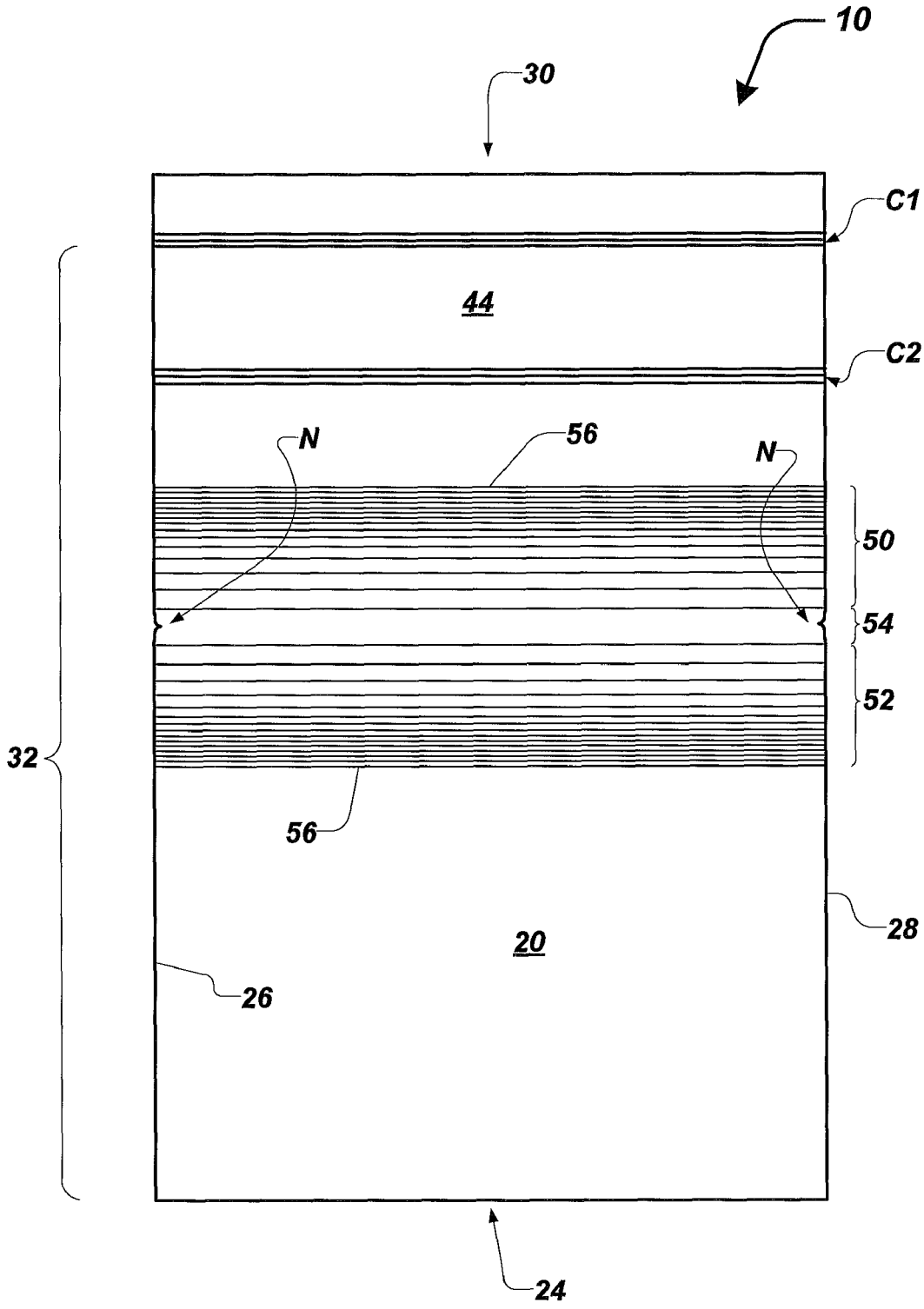
FIG. 6 is a front elevation view of a plastic bag according to a fourth embodiment of the present invention, showing the inclusion of notches in the sides of a plastic bag for initiating a tear.

Referring to a fourth embodiment illustrated in FIG. 6, the ease of tearing the tear area 54 can also be improved by providing tear initiation means such as notches N along the side edges 26, 28. The notches N do not compromise the integrity of the bag 10, but rather are simply alterations of the contour of each side edge 26, 28.

Figure 8:
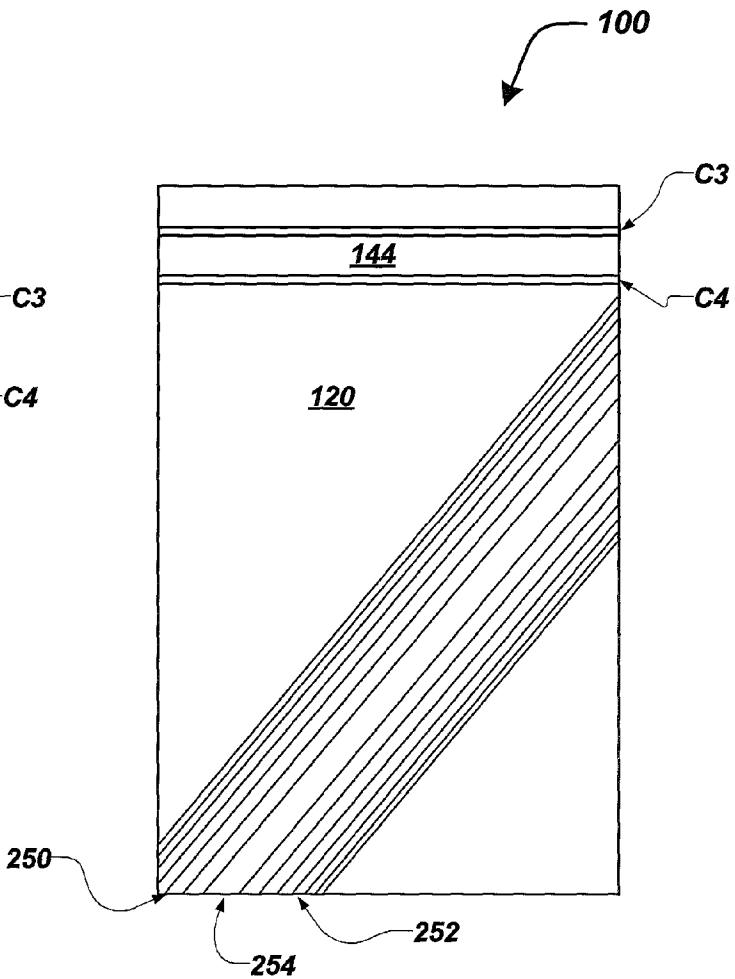
FIG. 8 is a front elevation view of a plastic bag according to yet another embodiment of the present invention, showing another alternative orientation of grip enhancing profiles.
Figure 7:
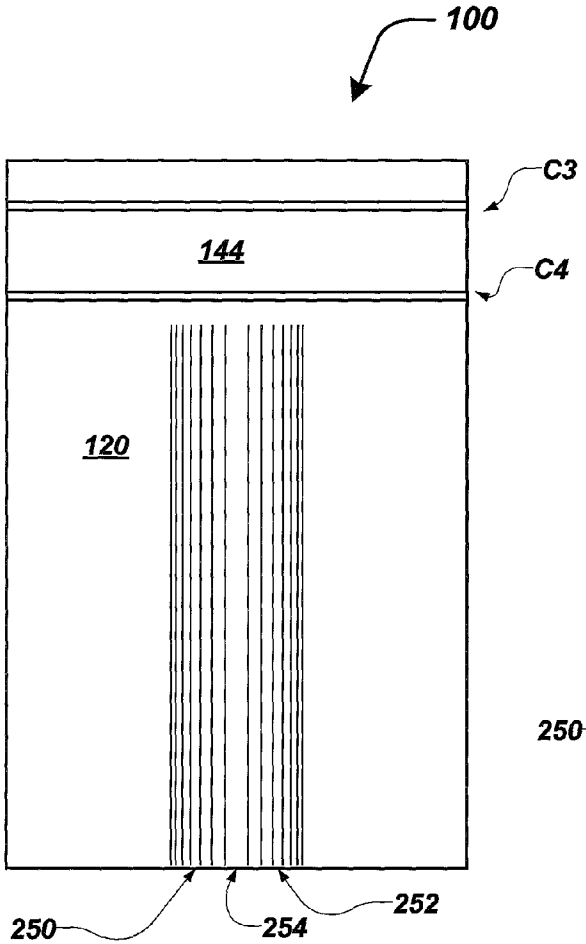
FIG. 7 is a front elevation view of a plastic bag according to another embodiment of the present invention, showing an alternative orientation of grip enhancing profiles.

With respect to the aforementioned embodiments, the raised ribs 56 are integrally formed with the walls of the bag 10 by extruding material through a die to produce tubular film. Thus, the grip enhancing profiles are transversely aligned on the bag 10. However, it is contemplated that an alternatively formed bag 100 may be of two piece construction, in which case the grip enhancing profiles can be longitudinally or diagonally aligned on the bag 100, as shown in FIGS. 7 and 8. The two parts of the bag 100 are joined by heat sealing the closures C3, C4 and lips 144, 146 to the upper edges of the front and rear walls 120, 122. In such embodiments, it is possible to extrude grip enhancing profiles 250, 252 that extend across the bag 100 at an orientation that is not parallel to the profiles of the closures C3, C4.

Figure 9:
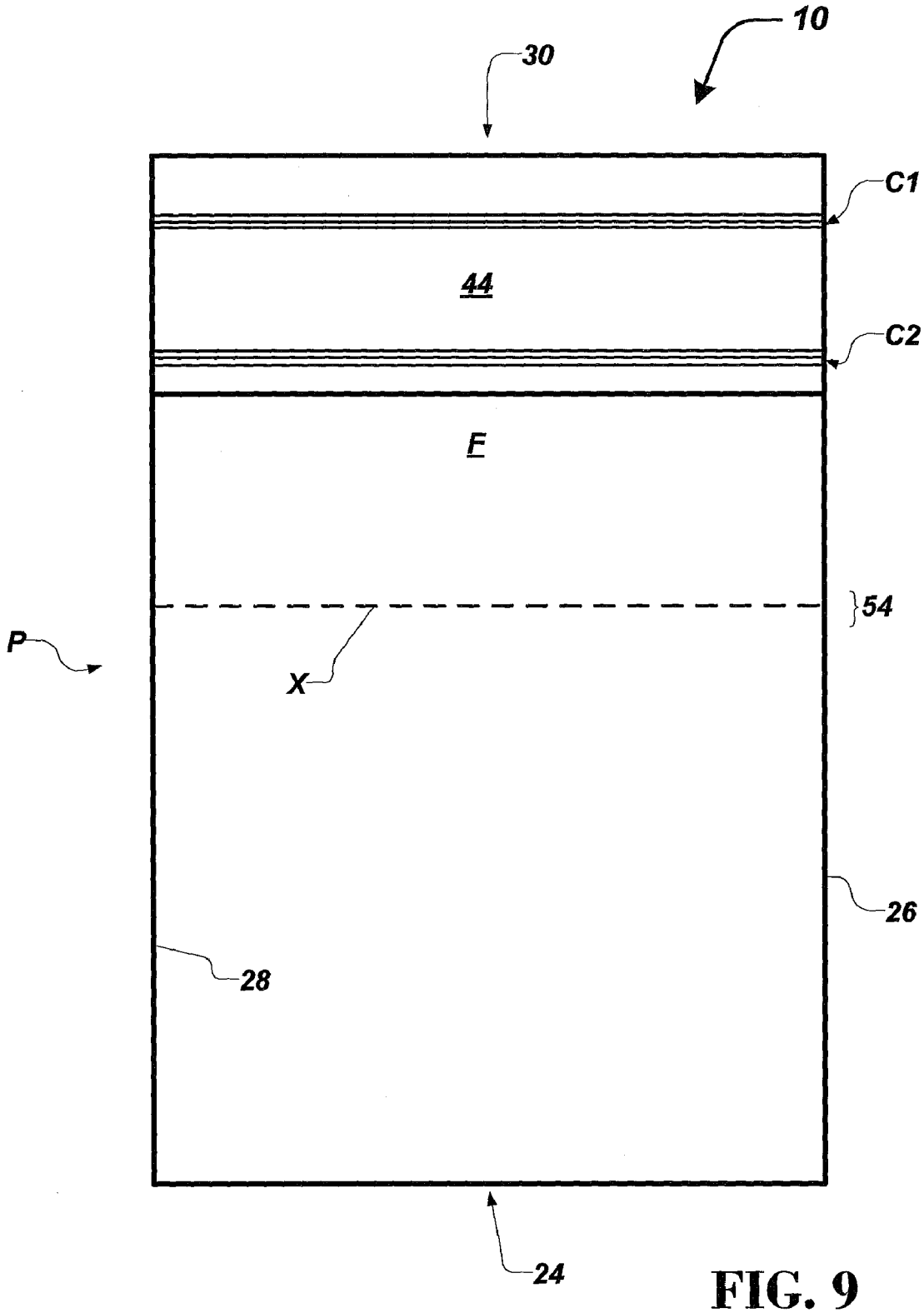
FIG. 9 is a rear elevation view of a plastic bag according to any of the embodiments of the present invention, showing a rear flap with a complementary severance line.

In any of the various embodiments, and as shown in FIG. 9, the plastic bag 10 can include a flap F or a third wall that, along with the rear wall 22, defines a pouch P. The pouch can be configured to receive documents that relate to the specimen that is enclosed within the containment portion 32. If the pouch P is configured to receive items other than an additional specimen, the flap can include a perforated line X that aligns with the tear area 54 to facilitate tearing the bag 10. If the pouch P is configured to receive an additional specimen, the third and fourth grip enhancing profiles 150, 152 can be alternatively formed on the third wall and an additional zipper-type closure (not shown) can be provided to seal the pouch P.

The present invention has been illustrated in relation to a particular embodiment which is intended in all respects to be illustrative rather than restrictive. Those skilled in the art will recognize that the present invention is capable of many modifications and variations without departing from the scope of the invention. For example, as used herein, directional references such as "top", "base", "bottom", "end", "side", "inner", "outer", "upper", "middle", "lower", "front" and "rear" do not limit the respective walls of the bag to such orientation, but merely serve to distinguish these walls from one another.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

The invention claimed is:

1. A plastic specimen bag, comprising:

a front wall and a rear wall joined together to define a containment portion having a bottom, side edges, and a top opening; and a first closure located between said bottom and said top opening for selectively closing said containment portion; and a first grip enhancing profile and a second grip enhancing profile formed in said front wall and spaced apart from one another to define therebetween a tear area for opening said containment portion, said tear area being located between said closure and said bottom;

wherein each of said first grip enhancing profile and said second grip enhancing profile comprises a series of raised ribs;

wherein the raised ribs in each said series of raised ribs are increasingly spaced apart as each said series approaches said tear area.

2. The specimen bag of claim 1, said tear area not having a thickness that is substantially less than the thickness of the remainder of said front wall.

3. The specimen bag of claim 1, wherein said first grip enhancing profile and said second grip enhancing profile define a front wall tear area; and wherein said specimen bag further comprises a third grip enhancing profile and a fourth grip enhancing profile formed in said rear wall and spaced apart from one another to define therebetween a rear wall tear area, said rear wall tear area being located between said closure and said bottom; and wherein said front wall tear area is substantially aligned with said rear wall tear area.

4. The specimen bag of claim 3, wherein said third grip enhancing profile is substantially aligned with said first grip enhancing profile and said fourth grip enhancing profile is substantially aligned with said second grip enhancing profile.

5. The specimen bag of claim 1, further comprising a flap joined to said rear wall to form a pouch, wherein said flap includes a severance line aligned with said tear area.

6. The specimen bag of claim 1, wherein said first closure comprises a male profile on one of said front wall and sear rear wall and a female profile on the other of said front wall and said rear wall, wherein said male profile and said female profile are capable of engaging one another to form a seal.

7. The specimen bag of claim 1, further comprising a second closure located between said first closure and said top opening.

8. The specimen bag of claim 7, wherein each of said first and second closures comprises a male profile on one of said front wall and said rear wall and a female profile on the other of said front wall and said rear wall, wherein said male profile and said female profile are capable of engaging one another to form a seal.

9. The specimen bag of claim 7, wherein at least one of said first closure and said second closure is a non-releasable closure.

10. The specimen bag of claim 1, further comprising means for initiating a tear in said tear zone.

11. The specimen bag of claim 10, wherein said tear initiation means comprises a notch in at least one of said side edges in said tear area.

12. The specimen bag of claim 1, wherein said first grip enhancing profile and said second grip enhancing profile extend substantially perpendicular to said side edges.

13. The specimen bag of claim 1, wherein said first grip enhancing profile and said second grip enhancing profile extend at an angle with respect to said side edges.

14. The specimen bag of claim 1, wherein said first grip enhancing profile and said second grip enhancing profile extend between said side edges.

15. A plastic specimen bag, comprising:

a front wall and a rear wall joined together to define a containment portion having a bottom, side edges, and a top opening; and a first closure located between said bottom and said top opening for selectively closing said containment portion; and a first grip enhancing profile and a second grip enhancing profile formed in said front wall and spaced apart from one another to define therebetween a tear area for opening said containment portion, said tear area being located between said closure and said bottom;

wherein each of said first grip enhancing profile and said second grip enhancing profile comprises a series of raised ribs;

wherein the raised ribs in each said series of raised ribs are decreasingly raised as each said series approaches said tear area.

16. A plastic specimen bag, comprising:

a front wall and a rear wall joined together to define a containment portion having a bottom, side edges, and a top opening; and a first closure located between said bottom and said top opening for selectively closing said containment portion; and a first grip enhancing profile and a second grip enhancing profile formed in said front wall and spaced apart from one another to define therebetween a tear area for opening said containment portion, said tear area being located between said closure and said bottom;

wherein each of said first grip enhancing profile and said second grip enhancing profile comprises a series of raised ribs;

wherein the raised ribs in each said series of raised ribs decrease in width as each said series approaches said tear area.

17. A plastic specimen bag, comprising:

a front wall and a rear wall joined together to define a containment portion having a bottom, side edges, and a top opening; and a first closure located between said bottom and said top opening for selectively closing said containment portion; and a first grip enhancing profile and a second grip enhancing profile formed in said front wall and spaced apart from one another to define therebetween a tear area for opening said containment portion, said tear area being located between said closure and said bottom;

further comprising a flap joined to said rear wall to form a pouch, wherein said flap includes a severance line aligned with said tear area;

wherein said first grip enhancing profile and said second grip enhancing profile define a front wall tear area; and wherein said specimen bag further comprises a third grip enhancing profile and a fourth grip enhancing profile formed in said flap and spaced apart from one another to define therebetween a flap tear area, said flap tear area being substantially aligned with said front wall tear area.

18. A plastic specimen bag, comprising:

a front wall and a rear wall joined together to define a containment portion having a bottom, side edges, and a top opening; and a first closure located between said bottom and said top opening for selectively closing said containment portion; and a first grip enhancing profile and a second grip enhancing profile formed in said front wall and spaced apart from one another to define therebetween a tear area for opening said containment portion, said tear area being located between said closure and said bottom;

wherein said first grip enhancing profile and said second grip enhancing profile extend substantially parallel to said side edges.

* * * * *